United States Patent [19]

Hemsath

[11] Patent Number: 4,789,333

[45] Date of Patent: Dec. 6, 1988

[54] CONVECTIVE HEAT TRANSFER WITHIN AN INDUSTRIAL HEAT TREATING FURNACE

[75] Inventor: Klaus H. Hemsath, Toledo, Ohio

[73] Assignee: Gas Research Institute, Chicago, Ill.

[21] Appl. No.: 129,010

[22] Filed: Dec. 2, 1987

[51] Int. Cl.[4] ..... F27B 3/22

[52] U.S. Cl. ..... 432/176; 432/199; 432/234; 432/250; 432/209

[58] Field of Search ..... 432/120, 136, 152, 159, 432/173, 176, 196, 199, 250

[56] References Cited

U.S. PATENT DOCUMENTS

| | | | |
|---|---|---|---|
| 2,776,128 | 1/1957 | Nesbitt et al. | 432/234 |
| 3,019,006 | 1/1962 | Lillienberg | 263/42 |
| 3,540,710 | 11/1970 | Yamagishi et al. | 263/41 |
| 3,565,410 | 2/1971 | Scherff | 266/5 |
| 4,142,712 | 3/1979 | Hemsath et al. | 266/44 |
| 4,167,915 | 9/1979 | Toole et al. | 118/708 |
| 4,354,827 | 10/1982 | Kissel | 432/176 |
| 4,427,378 | 1/1984 | Bowers | 432/250 |
| 4,516,012 | 5/1985 | Smith et al. | 432/176 |
| 4,527,974 | 7/1985 | Carraroli et al. | 432/78 |

*Primary Examiner*—Henry C. Yuen

*Attorney, Agent, or Firm*—Body, Vickers & Daniels

[57] ABSTRACT

An improved heat transfer arrangement for use in a unique multi-function, industrial heat treat furnace which employs a sealed, closed end, heat exchanger shell member containing the work. The heat transfer arrangement includes a totally contained, internal recirculation system which develops an especially configured annular jet stream that produces highly efficient, convective heat transfer with the shell member. After heat transfer between the entrained gases in the jet stream with the shell member has occurred, the jet flow is reversed at one end of the shell and impinged against the workpiece, the spent stream being reformed into the annular jet at the opposite end of the shell member.

16 Claims, 3 Drawing Sheets

CONVECTIVE HEAT TRANSFER WITHIN AN INDUSTRIAL HEAT TREATING FURNACE

This invention relates generally to a multi-function industrial heat treat furnace and more particularly to a batch type industrial heat treat furnace with an improved heat transfer arrangement for heating or cooling the work within the furnace.

The invention is particularly applicable to a convective heat transfer system for use in an industrial heat treat furnace which can be operated as either a standard atmosphere batch furnace or a vacuum heat treat furnace and will be described with reference thereto. However, the invention may have broader application and in a broader sense may be utilized as a closed loop recirculation system to effect heat transfer within a sealed area to an object.

INCORPORATION BY REFERENCE

The invention described herein relates generally to an industrial heat treat furnace described in my prior patent application entitled "HIGH TEMPERATURE CONVECTION FURNACE", Ser. No. 865,839 filed May 21, 1986, and which is incorporated herein by reference. The invention described herein also utilizes a door sealing arrangement described in my co-pending patent application entitled "SEAL ARRANGEMENT FOR HIGH TEMPERATURE FURNACE APPLICATION" filed as of the date of this application, Ser. No. 130,098, which is also incorporated herein by reference and referred to hereafter as my "co-pending" application.

BACKGROUND OF THE INVENTION

Batch type industrial heat treat furnaces are generally classified as either standard atmosphere furnaces or vacuum furnaces. When the furnace heat treats a load of loose ferrous workpieces placed in a tray or basket it is referred to as a batch type furnace to distinguish the furnace from the continuous type where individual workpieces are conveyed on an endless belt through the furnace and heat treated as they are passed through various furnace zones.

In a standard atmosphere batch furnace, the workpieces which are loosely placed in a tray or basket, are loaded into a furnace chamber where the atmosphere within the chamber is maintained generally at standard atmospheric pressure. More specifically, the atmosphere is maintained at a pressure slightly in excess of standard atmosphere to prevent oxygen from leaking into the furnace chamber as the workpieces are heated in a furnace atmosphere which is either generally inert or carefully controlled in composition to impart certain disassociated chemical components of the heat treating gas into the surface of the case (recarburizing or nitriding).

Most modern day atmosphere furnaces are heated either by electrical heating elements placed at strategic points within the furnace chamber (such as in an arch in the roof) or, more preferably and economically by gas burners firing their products of combustion into imperforate tubes made from high temperature alloys or ceramic materials which prevent any contact of the oxidizing gases with the reactive metal parts under atmosphere inside the furnace chamber. In some instances, electric resistance heaters are enclosed within the tubes. Heat from the hot tubes or electrical elements is then radiated to the workpiece and because of the limited surface areas involved, radiation heat shields are sometimes provided to speed up the heating time. Also, a fan is usually employed to circulate the furnace atmosphere against the tubes or the resistance elements and thence to the workpiece. While fans are obviously an improvement in reducing heating time, the convective heat transfer is obviously limited to the small surface area of the tubes or the resistance heaters and the velocity of the atmosphere gases wiping against the tubes and thence circulated within the workpiece basket. Generally speaking, the heating time is fundamentally limited because of the relatively small surface area of the heat source which limits the convection and radiation heat transfer. Heating by convection is further limited by the low velocity of the circulating atmosphere gases. To effect cooling of the workpieces after heating, a second quench chamber is usually provided in standard atmosphere furnaces. However, where single chamber furnaces are used or the heat treat process does not call for either furnace cooling or liquid quenching, cooling arrangements similar to those used for vacuum furnaces are employed.

Heat treat processes which alter the composition of the case of the workpiece to provide a hard surface which must be controlled to close tolerances (i.e., transmission gears, cams, etc.) are usually carried out in vacuum furnaces. During the heat treat process, the product gas disassociates at the elevated temperature and is drawn into or diffused into the case of the workpiece by a vacuum drawn on the chamber. Because the furnace chamber must be vacuum sealed, it is typically insulated by a water jacket casing. Because of sealing problems encountered with the water jacket, the gas fired radiant tubes used to heat the standard atmosphere furnaces cannot be used in vacuum furnace. Thus, all conventional vacuum furnaces typically use electric resistance heaters to heat the work. This results in a more expensive, at least at this time, process than that which would otherwise occur if gas burners could be utilized to heat the work.

Further, case heat treating processes generally require fast cooling of the workpiece after the case has been properly treated at an elevated temperature. When single chamber vacuum furnaces are utilized or when the heat treat process prohibits quenching, significant alterations of the vacuum furnace chamber are required to achieve the desired cooling rates by atmosphere cooling. Generally such arrangements are characterized as expensive, closed-loop recirculation systems which are situated outside the chamber. Such systems necessarily include a heat exchanger, duct work from the chamber to the heat exchanger and back, seals for the duct at the chamber and rather large fans or blowers to pump the atmosphere from the chamber through the heat exchanger and back again at sufficient velocities to achieve the required cooling rates. In addition, the furnace chamber is modified to include baffles or nozzles or baffles and nozzles to direct the furnace atmosphere at high velocity against the work and inherently, depending upon the geometric configuration of the parts and their stacked relationship within the basket, the nozzles and/or baffles may prove satisfactory for a certain part and unsatisfactory for another part thus requiring adjustment, etc. An example of a vacuum furnace employing such an arrangement as disclosed in U.S. Pat. No. 3,565,410 to Scherff.

Unrelated to industrial heat treat furnaces, but within the broad classification of the furnace art, are annealing coil cover arrangements which have long been used for annealing coiled steel strip produced in the steel mill processes. The box annealing concept bears some physical resemblance to the furnace disclosed in the present invention in that multi-stand annealers use an imperforate cover placed over stacked coiled strip surrounded by a box or stand which heats the cover. A fan is provided in the base of the stand to circulate the atmosphere within the cover and maintain some positive pressure to prevent leakage into the cover. The applications are entirely dissimilar. The annealing cycles are at a significantly lower temperature with much longer processing times than that acceptable for heat treat furnaces. The covers are thick massive steel objects which, along with the stand covers, must be lifted and replaced for each batch of work treated. Sand or loose fibrous seals are employed to seal the open end of the cover, and as noted, the fan is operated to cause a slight positive pressure to leak cover atmosphere past the seal. Such seals are not suitable for heat treat furnaces. They can't hold a vacuum, nor can they withstand the pressures generated in the heat treat furnaces without experiencing a leakage which, while acceptable in the steel mill annealing process because of the surrounding stand, can not be tolerated in heat treat furnaces. Thus, while high momentum heating has been used to speed the heating on the exterior of coil covers, such as that disclosed in one of my prior inventions, for example U.S. Pat. No. 4,142,712 issued Mar. 6, 1979 to Hemsath et al, the products of combustion have not been directed at the sand seal nor have high convective heat transfers occurred within the cover because of the seal integrity problem and because such covers have to be movable.

Also bearing some physical resemblance to the present invention and within the heat treat furnace art are muffle furnaces where a thick walled pipe member is structurally anchored at both of its ends to the furnace casing, thus defining a space between the pipe member and furnace casing used to heat the pipe member and the work placed therein. While such furnaces are suitable for certain applications involving continuous furnaces or furnace zones used in continuous furnaces, they are not widely used as simple chamber batch type furnaces because of, among other things, the excessive processing times to heat and core the work vis-a-vis the relatively thick walls of the muffle and the inability to use elastomer seals to efficiently seal the opening.

SUMMARY OF THE INVENTION

It is thus a principal feature of the present invention to provide an industrial heat treat furnace which can function either as a standard atmosphere furnace or as a vacuum furnace by employing an effective heat transfer arrangement.

This object along with other features of the invention is achieved by means of a furnace which comprises a thin imperforate shell member, preferably cylindrical in shape, with closed ends, which is positioned within and surrounded by a furnace casing of typical construction. Workpieces in a tray or basket are positioned in a centered relationship within the shell member. A heat source is provided as well as a cold source. Means are provided between the casing and the shell member to effect heat transfer between either the heat source or the cold source so that the shell member in turn becomes either a heat source or sink. Means are then provided within the shell member itself to generate an annular jet stream of entrained atmospheric gas to effect heat transfer between the shell member and the jet stream and the jet stream is then redirected to provide heat transfer between its entrained stream of gases and the workpieces. The total area of the shell member thus becomes a heat source or sink to significantly improve furnace chamber heat transfer, by both radiation and convection, with the workpiece.

In accordance with another feature of the invention, the annular jet, when initially formed, is unstable. A back pressure space or under pressure zone formed in the shell makes the jet unstable and causes the jet to expand into stable contact with the cylindrical inner surface of the shell. This produces a jet stream having generally turbulent flow between the inner surface of the shell and the outermost annular portion of the jet stream while the innermost annular portion of the jet stream is essentially laminar in flow thus maintaining the annular shape of the jet as it travels longitudinally along the cylindrical portion of the shell member while enhancing the heat transfer characteristics between the gases entrained within the annular jet and the shell member to produce a high heat transfer coefficient between the annular jet and the shell member.

In accordance with another feature of the invention, a recirculating plate is provided at the end of the shell member which causes the jet stream to reverse its axial or longitudinal direction of travel while maintaining its annular shape, preferably at a smaller diameter, to impinge against the workpieces in the work basket with a very high heat transfer coefficient.

In accordance with a yet more specific feature of the invention, another under pressure zone is created downstream of the workpiece causing the spent jet stream to enter such zone where it is pressurized and regenerated into the initial, unstable annular jet. In this manner, a closed loop recirculation system is provided entirely within the shell member thus obviating the need for external components characteristic of prior art devices.

In accordance with another feature of the invention, a cylindrical shroud is secured at one of its axial ends to one of the closed ends (preferably the door end) of the cylindrical shell member. A circular baffle plate is positioned inside of and at the opposite axial end of the shroud. The diameter of the outer edge of the baffle plate is less than the inside diameter of the shroud to define an annular space of a predetermined radial distance. The radial center of the annular space in turn is positioned a predetermined distance from the inside diameter of the shell. The baffle plate has a central opening therein. The door end of the shell member, the shroud and the baffle plate, define a very simple plenum chamber which holds the paddle blades of a radial fan driven by a relatively small and inexpensive motor at a velocity which develops a sufficient, unstable annular jet stream through the annular space. The spacing between the inside diameter of the shell member and the outside diameter of the shroud member provides a simple and efficient negative or under pressure zone which forces the unstable jet stream developed in the annular space to attach itself in a stable and high heat transfer manner to the inside diameter of the shell member. A simple dished, diverter plate placed at the opposite end of the shell member functions as diverting means for reversing the axial flow direction of the jet stream while still maintaining the annular characteristics of the jet stream.

It is thus an object of the invention to provide a heat transfer arrangement where the workpiece is placed within an enclosed chamber functioning as a heat source or sink and an annular jet stream is used so that the entire surface area of the chamber can be placed in convective as well as radiation heat transfer relationship with the work.

It is another feature of the invention to provide a heat treat furnace arrangement utilizing an improved heat transfer arrangement which can use gas fired burners as a source of heat when the furnace is operated as a vacuum furnace.

It is yet another object of the invention to provide a completely self-contained closed loop recirculation system for effecting heat transfer with the work within the furnace chamber of a heat treat furnace.

It is another object of the invention to provide a heat treat furnace which has high heat transfer ratios and which can function either as a standard atmosphere heat treat furnace or a vacuum heat treat furnace.

Yet another object of the invention is to provide a device for effecting high heat transfer coefficients, utilizing a closed loop recirculation scheme characterized by small horsepower requirements necessary to effect such heat transfer.

It is a general object of the invention to provide an improved heat transfer arrangement for use in an industrial heat treat furnace.

Still another object of the invention is to provide a convective heat transfer arrangement for use within a heat treat furnace which can be used to either heat the work or cool the work.

Yet still another object of the invention is to provide a heat transfer arrangement within a heat treat furnace which has such high efficiencies that the heating times and the cooling times required for the heat treat processes are materially reduced when compared to conventional processing times.

A still further object of the invention is to provide a furnace arrangement and a heat transfer system for use in such a furnace which is considerably simpler and more durable than that in conventional use today.

BRIEF DESCRIPTION OF THE DRAWINGS

The invention may take physical form in certain parts and arrangements of parts, a preferred embodiment of which will be described in detail and illustrated in the accompanying drawings which form a part hereof and wherein.

DETAILED DESCRIPTION OF THE PREFERRED EMBODIMENT

Figure 1:
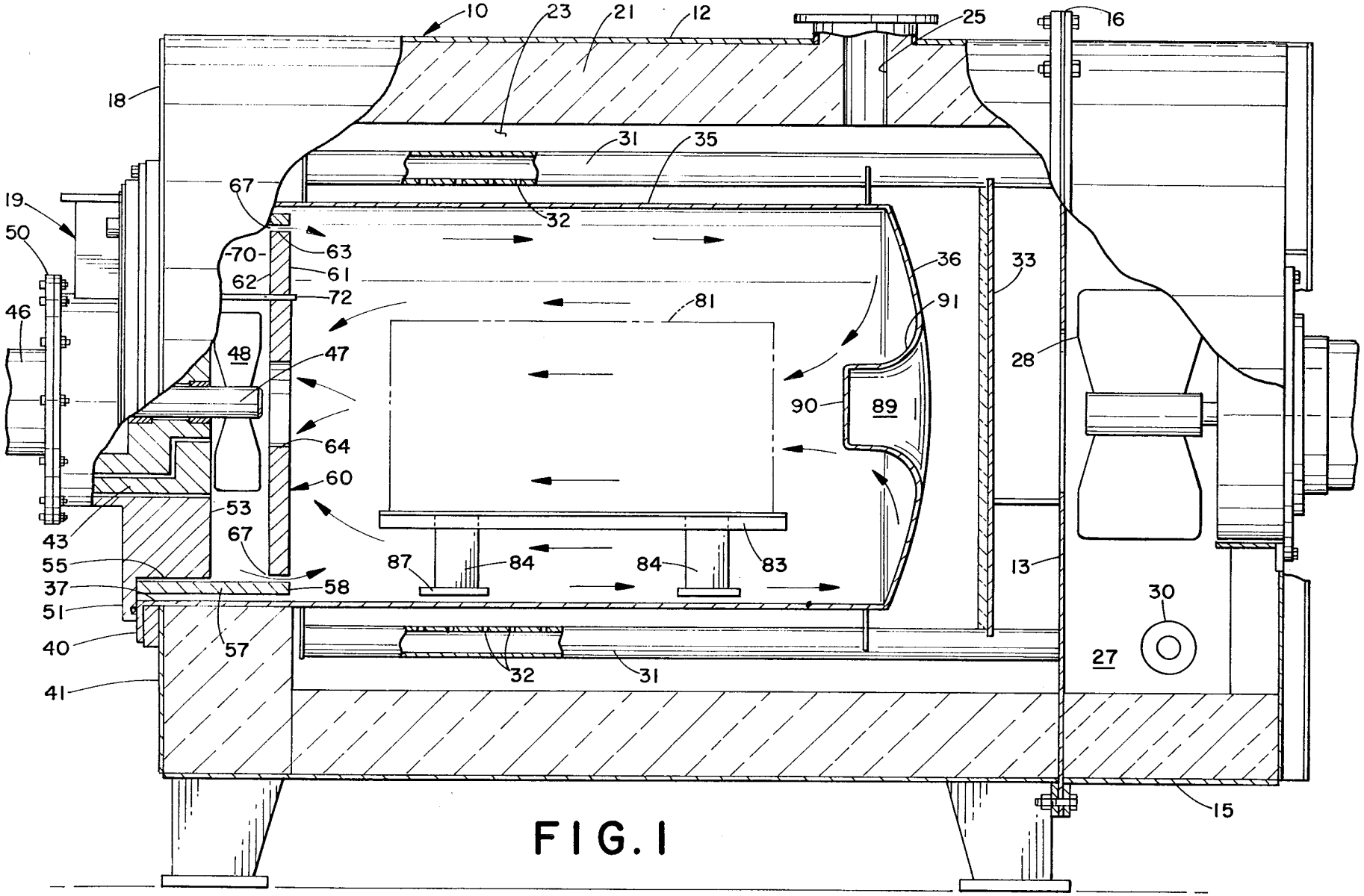
FIG. 1 is a side view of the furnace of the present invention with portions of the furnace broken away to illustrate particular interior details.
Figure 2:
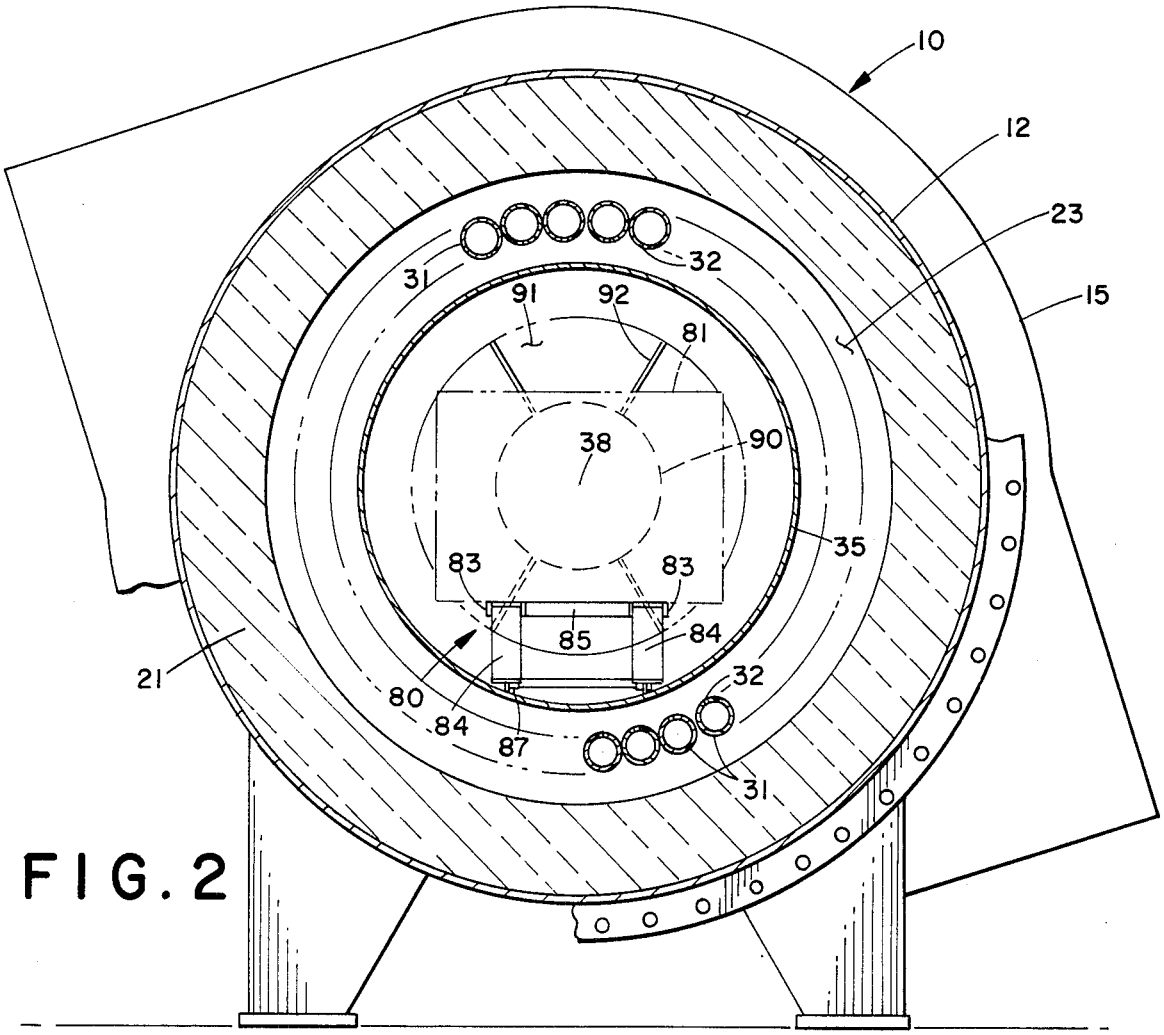
FIG. 2 is an end view of the furnace with portions of the furnace broken away.

Referring now to the drawings wherein the showings are for the purpose of illustrating a preferred embodiment of the invention only and not for the purpose of limiting the same, FIGS. 1 and 2 show a furnace 10 incorporating the principal features of the present invention. Furnace 10 generally comprises a central furnace casing section 12 which can be of any geometrical cross-section configuration, but for purposes of the preferred embodiment, is shown as cylindrical. Central casing section 12 is closed at its rearward end 13 by a rear block section 15 which is sealingly secured to rearward end 13 such as by bolted flanges 16 or other suitable securing means. Central furnace casing section 12 has a forward end 18 and a door indicated generally at 19 for opening and sealingly closing forward end 18. Central furnace casing 12 is constructed in accordance with normal furnace practices. In the furnace illustrated in the drawings, central furnace casing section 12 is lined with insulation and refractory material indicated generally by 21. Alternatively, central furnace casing section 12 could employ a conventional water jacket in lieu of insulation 21. As defined thus far, central furnace casing section 12, rearward end 13 and forward end 18 (along with door 19) define a closed end cylindrical chamber 23. A passage 25 in central furnace casing section 12 provides fluid communication between cylindrical chamber 23 and the stack (not shown) connected to passage 25 for exhausting spend products of combustion. A baffle (not shown) in the stack controls the overall pressure levels within cylindrical chamber 23.

For purposes of describing the particular structure of the furnace 10 illustrated in the drawings, the function of rear block section 15 is to supply heat to cylindrical chamber 23 or coolant to remvoe heat from cylindrical chamber 23. In my prior application (U.S. Ser. No. 865,839 filed May 21, 1986) an arrangement for providing heat to cylindrical chamber 23 is disclosed and is likewise utilized and shown in FIG. 1 hereof. Reference may be had to my prior application for a more detailed explanation than that set forth in this specification. For purposes of explaining the operation of furnace 10 in this specification, an outside plenum chamber 27 is formed in rear block section 15 into which is disposed a paddle bladed, radial fan 28. At least one gas burner 30 fires it products of combustion into outside plenum chamber 27 which thence travel into cylindrical chamber 23 through a plurality of longitudinally extending distribution tubes 31 which exhaust the products of combustion through apertures 32 in tubes 31 towards the center of cylindrical chamber 23. An insulated baffle 33 secured to rear block section 15 holds distribution tubes 31 in place while preventing the rear spherical end of an imperforate shell member 35 from being directly employed by gases emanating from plenum chamber 27. This arrangement is particularly useful when cooling is required. During cooling, gas burners 30 are, of course, shut off and a coolant can be injected into plenum chamber 27 and circulated through the distribution tubes 31 to cylindrical chamber 23. Air at ambient temperature is believed sufficient to achieve the desired cooling rates required for all conventional heat treat processes. Should, however, it be required that a cooler gas be used, a closed loop recirculation system could be easily constructed for furnace 10. For example, the baffle in the stack (not shown) would be closed and a takeoff secured to passage 25, a suitable heat exchanger included into the takeoff and the takeoff ported back through the gas burner jets 30 or through some other similar opening in the plenum chamber 27. Other arrangements are possible for cooling or heating cylindrical chambers and rear block section could be used only to cap the end of cylindrical casing section 12. The proper place for cooling and heating is outside of annular chamber 23. Heat can best be introduced into chamber 27 where it is readily mixed by the recirculation fan with recirculating gases. It is immaterial whether the heat is generated by gas firing or by electric heating elements. For cooling an outside cooling loop as described is the most efficient. The cooled gases will be injected into chamber 27 at the high pressure side of the recirculation fan. This requires that the outside cooling loop will have a pressurizing means on its own to transport the gases from the low pressure annular chamber 23 to the high pressure fan discharge chamber 27. However, it is significant to note that heating of the cylindrical chamber can be accomplished by means of gas burners which do not have to be operated at stoichiometric ratios to give complete combustion and this is so irrespective of furnace 10 being operated as a vacuum furnace or a standard atmospheric furnace.

Within cylindrical chamber 23 is a cylindrical, imperforate shell member 35 having a closed end 36, shown as generally spherical, and an open end 37 secured to forward end 18 of central furnace casing section 12. Shell member 35 could, in theory, have any tubular cross-sectional configuration. However, a cylindrical body with a constant circular cross-section (as opposed to frustoconical) is specifically preferred as the most efficient and least expensive configuration to achieve the highest coefficients of heat transfer. Imperforate shell member 35 is constructed from high alloy stainless steel, ⅜" or less, to achieve good heat transfer characteristics. Theoretically, imperforate shell member 35 could be manufactured from other material, in the future even from ceramics. However, stainless alloy steels like 300 and 800 series alloys will provide an acceptable life at temperatures of up to 2100° F.

Figure 1A:
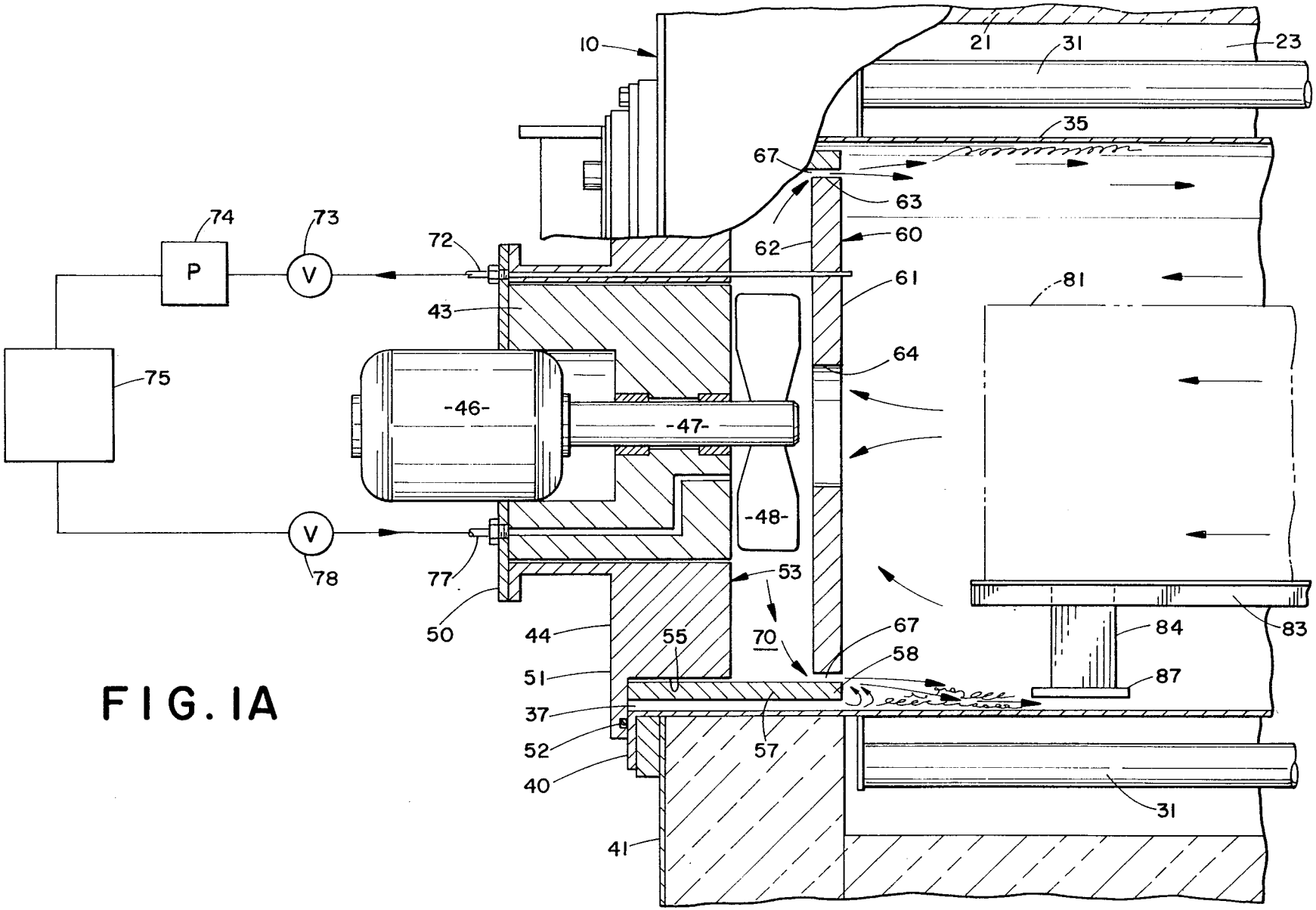
FIG. 1*a* is an enlarged view of a longitudinal portion of the furnace shown in FIG. 1.
Figure 3:
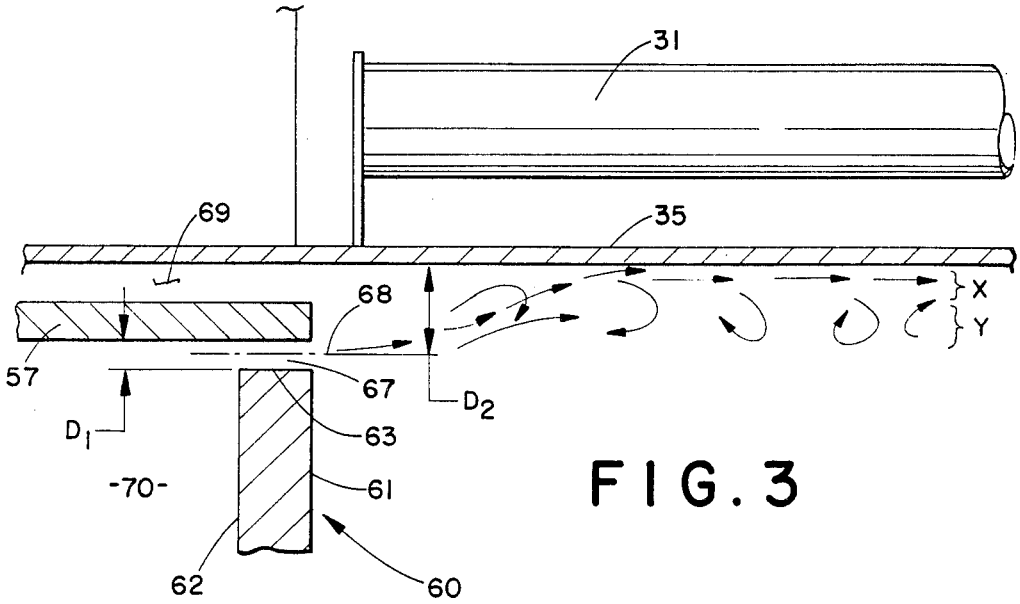
FIG. 3 is a further enlarged portion of the furnace shown in FIG. 1 illustrating the flow of the gases within the furnace.

Open end 37 of imperforate shell member 35 and forward end 18 of central furnace casing section 12 are sealed by means of door 19. Door 19 and the details of sealing open end 37 are more specifically disclosed in my co-pending application filed as of the data of filing this application and reference may be had thereto for a more complete discussion of such an arrangement. For purposes of the present invention and with reference to FIGS. 1 and 1*a*, open end 37 of imperforate shell member 35 may be defined by a flange 40 which is secured to a structural member 41 on forward end 18 of central furnace casing section 12. Door 19 may comprise an inner annular wall member 43 received within an outer annular wall member 44. A fan motor 46 whose shaft 47 carries paddle blade radial fan impellers 48 is journaled within inner annular wall member 43 and has a collar 50 which functions to secure inner and outer annular wall members 43, 44 together so that fan motor 46 along with inner and outer wall members 43, 44, in effect, make up door 19 for opening and closing the open end 37 of imperforate shell member 35. An annular flange 51 depending from outer annular wall member 44 which carries a conventional elastomer or O-ring seal 52 seals door 19 to flange 40 of imperforate shell member 35 when door 19 is in the illustrated closed position. The inner axial face surfaces of inner and outer annular wall members 43, 44 are axially aligned with one another and extend into cylindrical chamber 23 when door 19 is in the illustrated closed position and together define a door end wall 53. Outer annular wall member 44 has a cylindrical outer surface 55 which extends longitudinally from door end wall 53 to annular flange 51 and has a diameter which is less than the inside diameter of imperforate shell member 35. Secured to cylindrical outer surface 55 is an annular shroud member 57 which extends axially or in a longitudinal direction within imperforate shell member 35 a fixed distance beyond the plane of door end wall surfaces 53 and terminates at an annular edge surface 58. A circular baffle plate 60 having a forward face surface 61, a rearward face surface 62, a cylindrical outer surface 63 and a central, preferably circular, opening 64 is positioned within annular shroud member 57 so that forward face surface 61 is co-planar with annular edge surface 58 of annular shroud member 57. The diameter of cylindrical outer surface 63 of circular baffle plate 60 is less than the inside diameter of annular shroud member 57 and the radial distance between the two surfaces is defined by a distance $D_1$ as shown in FIG. 3 which in turn defines an annular orifice 67 for purposes which will be explained hereafter. Further, and with particular reference to FIG. 3 the center line 68 of orifice 67 is spaced a predetermined distance $D_2$ from the inner diameter of imperforate shell member 35. This in turn forms an under pressure or negative pressure zone 69 defined as the distance between the outside diameter of annular shroud member 57 and the inside diameter of imperforate shell member 35. Circular baffle plate 60 can be positioned with respect to annular shroud member 57 by any of several fastening methods. For example very thin spacers (not shown) radially extending from outer surface 63 can be welded to the outer edge 61 of annular baffle plate 60 and will maintain the concentricity of assembly 60 with respect to insulating shroud 57. Such thin sections will not create any significant resistance to the flow emerging from annular orifice 67. In a few places similar radially inward extending spacers are welded to outer edge 58 of shroud assembly 57. By joining a few of the radial spacers of the center baffle plate 60 with those of shroud 57 by tack welding or bolting, the two assemblies are attached to each other and form a pressurized chamber with an annular orifice outlet.

Rearward face surface 62 of circular baffle plate 60, door end wall 53 and the inner diametrical surface of annular shroud member 57 form a plenum chamber 70 which is entirely disposed within imperforate shell member 35 and which is essentially closed except for central opening 64 in circular baffle plate 60 and orifice 67. Centrally disposed within plenum chamber 70 are paddle blades 48. As blades 48 rotate a negative pressure is created through central opening 64 and a positive pressure exists at orifice 67 causing the gases within imperforate shell member 35 to flow in the direction of the arrows illustrated in FIGS. 1 and 1*a*.

Referring again to FIG. 1*a* and completing description of door 19 is a vacuum line 72 shown extending through outer annular wall member 44 through plenum chamber 70 and into the interior of imperforate shell member 35. Vacuum line 72 in turn is connected through conventional flex joints (not shown) to a valve 73 in turn connected to a pump 74. Pump 74 and valve 73 are regulated by conventional microprocessor controller 75. Also extending within inner annular wall member 43 is a gas inlet passage 77 in turn connected through conventional flex joints (not shown) to a gas flow valve 78 which in turn is regulated by microprocessor controller 75. Gas inlet passage 77 exits inner annular wall member 43 and opens into plenum chamber 70 at a position generally adjacent to or within an area circumscribed by central opening 64 which is an under pressure zone. When an inert gas or a heat treating gas is to be admitted into imperforate shell member 35, positioning gas inlet passage 77 in the under pressure zone of plenum chamber 70 assures quick mixing and distribution of the gas within imperforate shell member 35. Thus the gas jet which provides the convection heat transfer also functions as a mixing device for the process gas. Vacuum line 72 can also function as the return line for drawing the atmosphere gas (i.e., the now mixed gas) out of the imperforate shell member 35 thus controlling the pressure therein. Vacuum line 72 is shown extending through plenum chamber 70 and at a position away from orifice 63 and central opening 64 to assure that any gas withdrawn through pump 74 from imperforate shell member 35 has been thoroughly mixed. Gas inlet passage 77 as well as the gas outlet through vacuum line 72 are necessary in the operation of a single chamber furnace (whether vacuum or standard atmosphere) in that when door 19 is opened, oxygen is present within imperforate shell member 35 and the oxygen must be replaced by either an inert gas or a heat treating gas when the workpieces are initially heated and prior to the start of the heat treating process. All additional furnace processing sensing devices such as thermo-couples and gas composition sensors (not shown) are preferably inserted in imperforate shell member 35 through door 19 and not through any wall of imperforate shell member 35 so as not to adversely impact the imperforate characteristics of the shell. That is, and as explained in my co-pending application, there is significant contraction and expansion of imperforate shell member 35 during any heat treat process and any opening provided in the body of the shell could adversely affect the integrity of imperforate shell member 35. It should also be noted that once the heat treating process is underway, and the high convection heat transfer device is operating within imperforate shell member 35, valves 73, 78 are normally closed. Valves 73, 78 also are normally closed during cooling. However, it is possible to inject a cooled coolant gas through gas inlet passage 77 and maintain pressure through vacuum line 72 if a particularly steep cooling curve was required for some exotic metals. Microprocessor controller 75 has the capcity to regulate all such operations including cycling on and off the burner or resistance heating elements and then the cooling gases, etc. In addition, while it is contemplated that the inert or heat treat gases are mixed while the convective heat transfer is taking place, it is possible to simply effect the change over of the gases within shell member 35 vis-a-vis lines 72, 77 prior to forming the annular jet stream.

Referring now to FIGS. 1 and 2 a support 80 for the workpiece basket or tray 81 is shown to include two laterally spaced longitudinally extending inverted channel members 83 which function as rails for supporting workpiece basket 81 centered about the longitudinal center line 38 of imperforate shell member 35. Four columns 84 made up of channel members formed into a box configuration with opposing columns 84 appropriate braced by angle members 85 provide the support for rails 83. Importantly, the bottom of each column structure 84 is secured by two simple plates 87 placed on edge and tack welded to the interior of imperforate shell member 35 by special welding rods to avoid any weakening of imperforate shell member 35 at the location where plates 87 are secured to imperforate shell member 35. A possible alternative to support 80 could be to modify basket 81 by constructing legs of a predetermined height so that basket 81 could be lifted between the legs by the tines of a fork lift truck and simply placed within the cylindrical shell member.

Closed end 36 of imperforate shell member 35 could be flat and the invention described herein will function. However, a significant improvement in the heat transfer of the invention will occur if closed end 36 is semi-spherical in configuration with a diverter plate 89 formed or attached thereto. Diverter plate 89 includes a forwardly extending boss portion 90 which blends into semi-spherical closed end 36 by a dished portion 91 which has an appropriate radius of curvature providing a smooth transition from the closed end 36 to the boss portion 90. The diameter of the boss portion 90 is sized to be less than the cross-sectional area of workpiece basket 81 so that the full impact of the jet stream can impinge against the workpieces within workpiece basket 81. Also flow straightening flanges 92 (FIG. 2) can be provided in diverter plate 89 and flow straightening flanges 92 could be formed as a spiral if a spinning motion was desired to be imparted to the jet stream.

As thus far described, the operation of furnace 10 in a normal carburizing heat treat process will be described. Door 19 is open and an appropriate basket of ferrous workpieces placed, by fork lift truck, on support rails 83. A typical furnace 10 would have a shell diameter of about 40" and a workbasket size of approximately 24"×36"×18" holding a load of approximately 1000 lbs. Door 19 would then be sealed and gas burner 30 ignited to begin heating the exterior surface of imperforate shell member 35. Heat from imperforate shell member 35 would be transmitted by radiation to the workpieces in tray 81. At the same time, gas inlet passage 77 would be opened to admit an inert gas into imperforate shell member 35 while valve 73 and vacuum pump 74 regulated to exhaust the oxygen in the gas atmosphere, the interior of imperforate shell member 35 being maintained at a positive pressure and valves 73, 77 essentially operating together as a bleed valve unit to rid the interior of imperforate shell member 35 from any oxygen. Also, fan motor 46 would be actuated to cause rotation of shaft 47 thus causing flow of the gaseous atmosphere within imperforate shell member 35 to proceed in the flow path indicated by the arrows shown in FIG. 1. More specifically, an under pressure at central opening 64 in baffle plate 60 causes a suction of the atmosphere into plenum chamber 70 with the paddle blades 48 then compressing the gases and forcing them to exit plenum chamber 70 through orifice 67 into an annular jet. The annular jet travels the length of imperforate shell member 35 until it is reversed 180° in axial direction by diverter plate 89 to impinge as a smaller annular jet against basket 81. As the jet travels through basket 81 it decays and becomes spent as heat exchange occurs from impact with the workpieces within basket 81 ("Spent jet" as used herein simply refers to the fact that the jet stream has effected heat transfer with the work. The jet stream may no longer have the velocity of a jet stream. However, the momentum of the gases entrained within the jet carry the gases back towards central opening 64). The spent jet at a considerably lesser velocity exits basket 81 and impacts toward face surface 61 of baffle plate 60 where it is drawn by suction into central opening 64 in baffle plate 60 whereat it is again reformed into a jet through orifice 67. While the work is heated by convection from the annular jet and by radiation from the entire interior surface area of imperforate shell member 35, valves 73, 78 have closed once the substantially inert atmosphere has been produced. When the work is at the appropriate carburizing temperature, typically anywhere between 1750°-1950° F., a carburizing gas is now admitted through gas inlet 77. If the furnace is to be operated as an atmosphere furnace, fan motor 46 stays on and the carburizing gas is sucked or drawn in with the atmosphere gas through the central opening 64 or under pressure zone of plenum chamber 70 and expelled through the annular jet formed by orifice 67. When the annular jet effects heat transfer contact with imperforate shell member 35, the disassociated carburizing or product gas is mixed with the atmosphere or carrier gas and when the jet is reversed at diverter plate 89, the disassociated carbon is uniformly impinged against the workpieces. Thus the velocity of the jet results in a faster carburizing time and the mixing within the jet produces a more uniform carbon case.

If furnace 10, however, is to function as a vacuum furnace once the work in basket 81 has reached the appropriate carburizing temperature, fan motor 46 is shut off and a vacuum is drawn within imperforate shell member 35 by pump 74. At this point in time, imperforate shell member 35 and the workpieces within tray 81 are all at the same temperature and the firing of burner 30 is controlled to maintain all furnace components at the same temperature by radiation from imperforate shell member 35. The carburizing portion of the cycle is carried out in the same manner as it is normally carried out in a conventional vacuum furnace with the carbon admitted either in a carrier gas or directly pulsed, periodically, into the chamber but with the added difference that the entire shell member and not just a few electric resistant elements heat the work by radiation, thus providing a more responsive furnace than prior art vacuum furnaces simply on the basis of surface area consideration.

Once the carbon has reacted with the surface or case and absorbed in the case in the atmosphere furnace process or diffused into the case of the workpieces by the vacuum boost diffuse cylces, the work is then cooled. This is efficiently accomplished as suggested above by shutting down burners 30 and admitting ambient air into the outer plenum chamber 27 which immediately begins to cool imperforate shell member 35. Again, the work in tray 81 loses heat by radiation to the cooler imperforate shell member 35 and the convective heat transfer instantly occurs when fan motor 46 is started and an inert gas, i.e., nitrogen, is admitted through opening 19, the system again generating the annular jet flows described in the heating process. In this case, the jet stream obviously becomes cool as it loses heat to the shell member and the cooler jet stream then acts to cool the hot workpieces in basket 81 while the atmosphere is controlled to be inert.

It is essential to the functioning of the invention that the annular jet stream developed at orifice 67 be controlled in shape while also maintaining sufficient flow characteristics to generate a good heat transfer relationship with the cylindrical surface of imperforate shell member 35. While the reasons why excellent heat transfer occurs between the annular jet and the imperforate shell member 35 in the present invention may not be precisely understood in all details, several factors which are believed to affect the annular jet stream and the resulting heat transfer relationship are shown in FIG. 3. In accordance with conventional techniques, the annular jet stream is a function of the size of the annular space of orifice 68 designated as $D_1$ and the pressure of the gas in plenum chamber 70 at that point. An annular space having the dimension $D_1$ of about $\frac{3}{8}$ to about $1\frac{1}{2}$ inches at pressures of about 1 inch W.C. to about 10 inches W.C. will produce an annular jet stream of velocities anywhere from 4000 to about 15000 FPM which are believed sufficient to obtain highly efficient heat transfer characteristics. The center of the annular jet is spaced a predetermined distance $D_2$ away from the inner cylindrical surface of shell member 35. Spacing $D_2$ multiplied by the axial width of shroud member 57 produces, as noted above, a defined area of a negative pressure zone 69. The existence of the negative pressure zone 69 causes the annular jet stream of gas produced at orifice 67 to be unstable and to expand at an angular relationship or more specifically as a frusto-conical jet until it impacts the inner cylindrical surface of shell member 35. That is, from the annular orifice an annular jet is discharged. This jet expands freely until its outer surface impinges upon the surrounding surface of imperforate shell. As a result the jet is somewhat deflected outwardly by the influence of a low pressure region which is set up between outer shroud 57 and imperforate shell 35. The jet attaches itself to imperforate shell 35 and flows along its surface towards its closed end 36. Because it is attached to the wall the jet has a much farther reach with attendant heat transfer capability than a free jet would have. At the closed end the annular jet is reversed in direction by baffle means 87 with its radial flow straightening vanes 91. The jet is redefined by the action of the flow reversing device and emerges as an annular jet of smaller diameter and velocity but directed towards the rear surface of the basket of tray 81. This jet has sufficient momentum left to effectively transfer heat from the gas to the load when heating or from the load to the gas when cooling.

The jet essentially maintains its turbulent character all the time due to its large surface area and the intense mixing action on its free surface. Near the wall the boundary layer will become laminar after the jet has travelled away from the discharge opening 67. But heat transfer along the entire surface of imperforate shell 35 will be high due to the advantageous heat transfer conditions of the selected configuration.

The jet dimensions have a bearing on the heat transfer performance of the entire convective transfer arrangement. The thickness of the jet should preferentially not become too large as not to interfere with the surfaces of the work basket. Velocities, naturally, should be as high as possible to generate highest transfer rates. But both mass flow and allowable pressure raises by fan 48 will increase fan horsepower and maximum blade temperatures quickly restrict maximum achievable horsepower. Jet dimensions are accordingly kept small and the annular opening is typically between $\frac{3}{8}$ and $1\frac{1}{2}$ inches.

The invention has been described with reference to a preferred embodiment. It is apparent that many modifications may be incorporated into the furnace disclosed without departing from the spirit or the essence of the heat transfer characteristics of the invention. For example, a single chamber furnace is disclosed and it should be apparent that shell member 35 could be configured in such a manner to work with a quench chamber and even a vestibule while still employing the essential characteristics of the invention. Similarly, it is conceivable that the batch furnace disclosed could be modified with appropriate baffles and arches and curtains so as to function as a continuous furnace. Further, while the jet stream as disclosed is shown to originate at one end of the shell and is redirected at the opposite end, it is possible, in a multi-chamber or multi-zone furnace application, to originate the jet stream at the center and encase two jet streams to emanate in opposite axial directions and then reform at the under pressure zone in the plenum. It is my intention to include all such modifications and alterations insofar as they come within the scope of the present invention.

It is thus the essence of my invention to provide an improved heat treat furnace and a heat transfer arrangement used therein which utilizes unique jet stream convective heat transfer with the work while providing an inherent increase in radiation heat transfer.

Having thus defined my invention, I claim:

1. An industrial heat treat furnace comprising:
(a) an insulated furnace casing defining an enclosure;
(b) a sealed, imperforate, generally thin walled, shell member having a closed end within said enclosure, said shell member containing an atmospheric gas initially at a first temperature;
(c) at least one workpiece within said shell member;
(d) source means remotely situated from said shell member for generating a fluid medium at a second temperature different than said first temperature;
(e) heat transfer means in communication with said source means and situated within said enclosure relatively close to said shell member to effect heat transfer between said fluid medium at said second temperature and the exterior of said shell member's thin wall so that the temperature of said shell member's thin wall approaches said second temperature; and
(f) jet pump means within said shell member producing an annular jet of atmosphere gas traveling the length of said shell member, said annular jet having an initial diameter when formed at a position remote from said closed end smaller than the inside diameter of said shell member, said jet pump means causing said annular jet to expand into contact with said shell member's thin wall as it travels the length thereof to effect significant heat transfer between said shell member's thin wall and that portion of said atmosphere gas entrained within said jet, and thereafter to impinge said jet against said workpiece to cause heat exchange therebetween.

2. The heat treat furnace of claim 1 wherein said jet pump means further includes under pressure zone means within said shell member causing said annular jet stream to be unstable at the point of origin in said shell member and expand in a stabilized annular shape as said jet travels the length of said shell member, said annular jet having an essentially laminar flow with a portion of said atmosphere gas entrained therein at the outside diameter of said expanded jet and a generally turbulent flow of entrained atmosphere gas at the inside diameter of said jet to effect said heat transfer.

3. The heat treat furnace of claim 2 wherein said means within said shell member to effect heat transfer further includes recirculating means for directing said gas within said annular jet after it has travelled some portion of the length of said shell member to impinge against said workpiece as a jet stream to effect heat transfer therebetween and thereafter directing the spent jet to said jet pump means.

4. An industrial heat treat furnace comprising:
(a) an insulated furnace casing defining an enclosure;
(b) a sealed, imperforate, generally cylindrical, thin walled shell member within said enclosure, said shell member containing an atmosphere gas initially at a first temperature;
(c) at least one workpiece within said shell member;
(d) source means remotely situated from said shell member for generating a fluid medium at a second temperature different than said first temperature;
(e) heat transfer means in communication with said source means and situated within said enclosure relatively close to said shell member to effect heat transfer between said fluid medium at said second temperature and said shell member so that the temperature of the shell member's thin wall approaches said second temperature;
(f) means within said shell member to generate a jet of entrained atmospheric gas and to effect convective heat transfer from said thin wall of said shell member to said atmospheric gas within said jet and to effect convective heat transfer from said entrained atmospheric gas to said work;
(g) said means to generate a jet including jet pump means to originate an annular jet of said atmospheric gas which expands into contact with said shell member's wall to effect heat transfer between said shell member's wall and said expanded jet stream as said atmospheric gas within said expanded jet stream travels a length of said cylindrical shell member, and recirculating means for directing said gas within said expanded jet stream after it has travelled some portion of the length of said shell member to impinge against said workpiece as a jet stream to effect heat transfer therebetween and then to said jet pump means; and
(h) said recirculating means includes diverter plate means at one of said shell member's ends for reversing the axial flow direction of said annular jet as a smaller diameter annular jet to cause impingement with said work.

5. The heat treat furnace of claim 4 wherein said jet pump means includes a plenum chamber, said plenum chamber having an annular opening, and pump means within said opening for generating said annular jet through said opening, said recirculating means including said plenum chamber having an under pressure zone opening therein.

6. The heat treat furnace of claim 5 further including valve means for admitting a gas for heat treating purposes adjacent said under pressure zone opening and withdrawing a portion of said gases within said shell member, said jet pump means effective to cause a mixing of said gas admitted into said shell member while effecting heat transfer with said shell member.

7. The heat treat furnace of claim 6 wherein said jet pump means further includes an under pressure zone means causing said jet stream to become unstable when originated and expanded in a stabilized annular shape as said jet stream travels the length of said shell member with an essentially laminar flow of a portion of said atmosphere gas entrained at the outside diameter of said expanded jet and a generally turbulent flow of entrained gas at the inside diameter of said jet to effect said heat transfer.

8. The heat treat furnace of claim 4 wherein said jet pump means includes a fan contained within said shell member at one end thereof, a generally circular baffle plate within said shell member positioned between said fan and the other end of said shell member, said baffle having a central opening defining the inlet of said fan and a generally circular outer edge having a predetermined diameter, a generally cylindrical shroud extending from said end adjacent said fan and overlying said baffle plate to define an annular space between said shroud and said circular edge, said annular space defining an orifice to produce said annular jet while also defining the outlet of said fan.

9. The heat treat furnace of claim 8 wherein said end wall adjacent said fan, said baffle plate and said shroud defines a plenum chamber housing said fan and the space between the outer diameter of said shroud and the inner diameter of said shell member defining an under pressure zone causing said jet to expand into contact with the inner surface of said cylindrical shell member.

10. The heat treat furnace of claim 9 wherein said annular space having a radial distance between $\frac{3}{8}$ and $1\frac{1}{2}$ inches for fan pressures within said plenum between 1 and 10 inches W.C.

11. The heat treat furnace of claim 10 wherein said velocity of said expanded jet in the longitudinal direction of said shell member is between 4000 and 15000 feet per minute.

12. The heat treat furnace of claim 1 wherein means are provided within said furnace to maintain said workpiece centered about the longitudinal center of said shell member, and said shell member further including a diverter plate at the end of said shell member opposite said fan end whereby said jet stream is directed to impinge against said workpiece.

13. The heat treat furnace of claim 1 further including means to admit gas suitable for heat treating processes into said shell and valve means to withdraw an amount of said atmospheric gas in proportion to the volume of said heat treating gas added to said shell while heat transfer is occurring by said jet pump means.

14. The heat treat furnace of claim 1 further including means to draw a vacuum within said shell member for selectively operating said heat treat furnace as a batch type vacuum heat treat furnace as well as a standard atmosphere batch type heat treating furnace.

15. The heat treat furnace of claim 1 wherein said shell member is not greater than about $\frac{3}{8}$ inch thickness to assure said heat transfer.

16. The heat treat furnace of claim 1 further including said source means initially effecting heat transfer between said shell member and said fluid medium at a temperature higher than the temperature to said atmosphere gas and subsequently effecting heat transfer between said shell member and said fluid medium at a temperature lower than the temperature of said atmosphere gas.

* * * * *